US007165469B2

(12) United States Patent
Niemi et al.

(10) Patent No.: US 7,165,469 B2
(45) Date of Patent: Jan. 23, 2007

(54) SHIFT ROD PISTON SEAL ARRANGEMENT FOR A VIBRATORY PLATE COMPACTOR

(75) Inventors: Eric A. Niemi, West Allis, WI (US); Michael W. Schmitt, Allenton, WI (US)

(73) Assignee: M-B-W Inc., Slinger, WI (US)

( * ) Notice: Subject to any disclaimer, the term of this patent is extended or adjusted under 35 U.S.C. 154(b) by 321 days.

(21) Appl. No.: 10/411,598

(22) Filed: Apr. 10, 2003

(65) Prior Publication Data

US 2004/0200299 A1 Oct. 14, 2004

(51) Int. Cl.
*E01C 19/34* (2006.01)

(52) U.S. Cl. ..... 74/87; 404/133.05

(58) Field of Classification Search ..... 74/61, 74/87; 404/133.05, 133.1, 113; 173/49, 173/213

See application file for complete search history.

(56) References Cited

U.S. PATENT DOCUMENTS

| | | | | | |
|---|---|---|---|---|---|
| 3,490,341 | A | * | 1/1970 | Sessody | 92/30 |
| 3,667,345 | A | * | 6/1972 | Schaedler et al. | 91/59 |
| 3,783,701 | A | * | 1/1974 | Steprath et al. | 74/87 |
| 4,176,983 | A | * | 12/1979 | Gardner | 404/117 |
| 4,356,736 | A | * | 11/1982 | Riedl | 74/61 |
| 4,454,780 | A | * | 6/1984 | Goehler et al. | 74/87 |
| 4,481,835 | A | * | 11/1984 | Storm | 74/61 |
| 4,499,779 | A | * | 2/1985 | Maass | 74/61 |
| 4,568,218 | A | * | 2/1986 | Orzal | 404/117 |
| 4,749,305 | A | * | 6/1988 | Brown et al. | 404/117 |
| 4,771,645 | A | * | 9/1988 | Persson | 74/61 |
| 4,903,783 | A | * | 2/1990 | Rushanan et al. | 173/177 |
| 4,978,488 | A | * | 12/1990 | Wallace | 264/72 |
| 5,010,778 | A | * | 4/1991 | Riedl | 74/61 |
| 5,177,386 | A | * | 1/1993 | Shimada | 310/81 |
| 5,234,085 | A | * | 8/1993 | Schneider | 188/282.8 |
| 5,387,052 | A | | 2/1995 | Artzberger | |
| 5,818,135 | A | * | 10/1998 | Riedl et al. | 310/81 |
| 6,047,546 | A | * | 4/2000 | Takeyama | 60/533 |
| 6,227,760 | B1 | * | 5/2001 | Togami et al. | 404/84.1 |
| 6,564,918 | B2 | * | 5/2003 | Itoh | 192/85 C |
| 2002/0104393 | A1 | | 8/2002 | Van Es et al. | |

FOREIGN PATENT DOCUMENTS

| | | |
|---|---|---|
| EP | 0 473 449 | 8/1991 |
| JP | 1-260107 | * 10/1989 |

* cited by examiner

*Primary Examiner*—William C. Joyce
(74) *Attorney, Agent, or Firm*—Andrus, Sceales, Starke & Sawall, LLP

(57) ABSTRACT

An easily accessible phase adjustment mechanism for a vibratory plate compactor includes an improved seal arrangement to protect against leakage of internal lubricating oil into the hydraulic cylinder providing fluid pressure to the adjustment mechanism. An easily demountable cylinder housing provides ready access to the piston and seal assembly which can then be threadably detached and replaced in its entirety.

7 Claims, 4 Drawing Sheets

SHIFT ROD PISTON SEAL ARRANGEMENT FOR A VIBRATORY PLATE COMPACTOR

BACKGROUND OF THE INVENTION

The present invention relates to manually operated vibratory plate compactors and, more particularly, to an improved seal arrangement for the piston of a shift rod used to control movement of the compactor. The seal arrangement is readily accessible and the seals may be individually replaced or a new piston and seal subassembly substituted for the subassembly needing repair or replacement.

Manually operated vibratory plate compactors are well known and commonly used for compacting soil in back-fill, sub-grade and other construction activity compaction applications. In one typical vibratory plate compactor, pairs of parallel shafts carrying eccentric weights are rotated by driving one shaft and transmitting the rotation to the other with a gear arrangement. The eccentric weight arrangement and a drive engine are mounted on a substantially flat compaction plate. An operator's handle with controls is also attached to the plate frame. The operator controls include an actuator which can be used to adjust the rotational position of the eccentric weights on the shafts. Such adjustment alters the phase and vector of the forces generated by the eccentric weights such that the plate compactor may be made to move in a forward direction, a reverse direction, or to remain horizontally stationary, all while imposing vertical compacting forces on the surface beneath the plate.

One common means for adjusting the phase of the eccentric weights is to use a hydraulic actuator including a piston mounted coaxially in or with respect to a bore in the driven input shaft of the apparatus, the piston connected by a shift rod to a carrier head carrying a cross pin that engages a helical groove on the ID of the main input shaft bore. Movement of the shift rod assembly axially in the input shaft bore provides the rotation of the shaft and attached eccentric weights to adjust the phase. Such apparatus is shown, for example, in U.S. Pat. Nos. 4,356,736; 5,010,778; and 5,818,135.

In all of the prior art apparatus of the foregoing general type, the shafts carrying the eccentric weights and drive gears are encased in a housing partially filled with a liquid lubricating oil. The piston on the shift rod is typically connected to a supply of hydraulic fluid which is applied to the free end of the piston, operating either in a bore in the input shaft or in a cylinder housing attached coaxially to the shaft, to move the carrier and cross pin on the opposite end of the shift rod axially to rotate the input shaft for phase adjustment, thereby adjusting the speed and direction of forward and reverse movement of the compactor.

It is known in the prior art to provide the shift rod piston with a seal to prevent hydraulic fluid in the piston cylinder from bypassing the piston and escaping into the main housing. The seal is typically a uni-directional type such as a lip seal or cup seal that expands with increasing hydraulic pressure to inhibit leakage. When actuating hydraulic pressure on the piston is reduced or relieved, the eccentric weights shift in an opposite rotational direction under the influence of rotation of the main input or drive shaft to initially reduce the speed of movement in one direction (typically reverse) to a neutral or horizontally stopped position and then to increase speed in the opposite (forward) direction. Thus, the shift rod piston needs only to be single-acting and, therefore, it has been assumed in the prior art that a unidirectional piston seal to prevent leakage of pressurized hydraulic fluid was adequate.

It has been found, however, that under certain circumstances of operation, lubricating oil in the main housing can become pressurized and escape past the uni-directional seal on the piston where it becomes trapped in the cylinder housing. The lubricating oil in the housing may become pressurized as a result of high temperatures generated during operation. Also, the rapidly rotating shafts in the housing tend to stir up the lubricating oil causing it to atomize and, under pressure, seep past the seal. The accumulation of lubricating oil in the chamber intended to receive pressurized hydraulic fluid interferes with proper movement of the piston and, as a result, eventually interferes with operating movement of the compactor.

The high operating temperatures experienced by these kinds of vibratory plate compactors also create a hostile environment for any type of seal. Thus, the prior art piston seal must be periodically replaced and great care must be taken to avoid contamination of the interior of the housing during seal replacement. In addition, the construction of prior art apparatus has made seal replacement tedious and time consuming, sometimes requiring the removal of the main housing cover and partial disassembly of the eccentric weights from the drive shaft to access the shift rod and piston so the seal may be replaced. Opening the cover plate for the main housing also exposes the entire interior of the mechanism to potential contamination.

SUMMARY OF THE INVENTION

In accordance with the present invention, the shift rod piston is provided with a double seal to protect against leakage of pressurized lubricating oil from the interior of the housing in cooperation with a prior art piston seal to prevent the ingress of hydraulic fluid from the cylinder housing. An improved demountable cylinder housing makes access to the shift rod and piston much easier and the piston is demountably attached to the shift rod so that the entire subassembly of a piston head and new seals may be easily substituted for the old and worn subassembly.

In accordance with the preferred embodiment of the invention, the demountable connection of the piston to the shift rod comprises a threaded connection. The annular piston seals preferably comprise cup seals oriented to face in opposite axial directions. The cylinder housing preferably includes an integral peripheral outer flange that is adapted to engage the outer wall of the main housing. A mounting plate comprising an annular clamping plate holds the cylinder housing flange in engagement with the outer wall and is held in place with a plurality of threaded fasteners. The bore in the cylinder housing preferably comprises a through bore to facilitate machining. A demountable cover plate encloses the outer end of the through bore.

DETAILED DESCRIPTION OF THE PREFERRED EMBODIMENT

Figure 4:
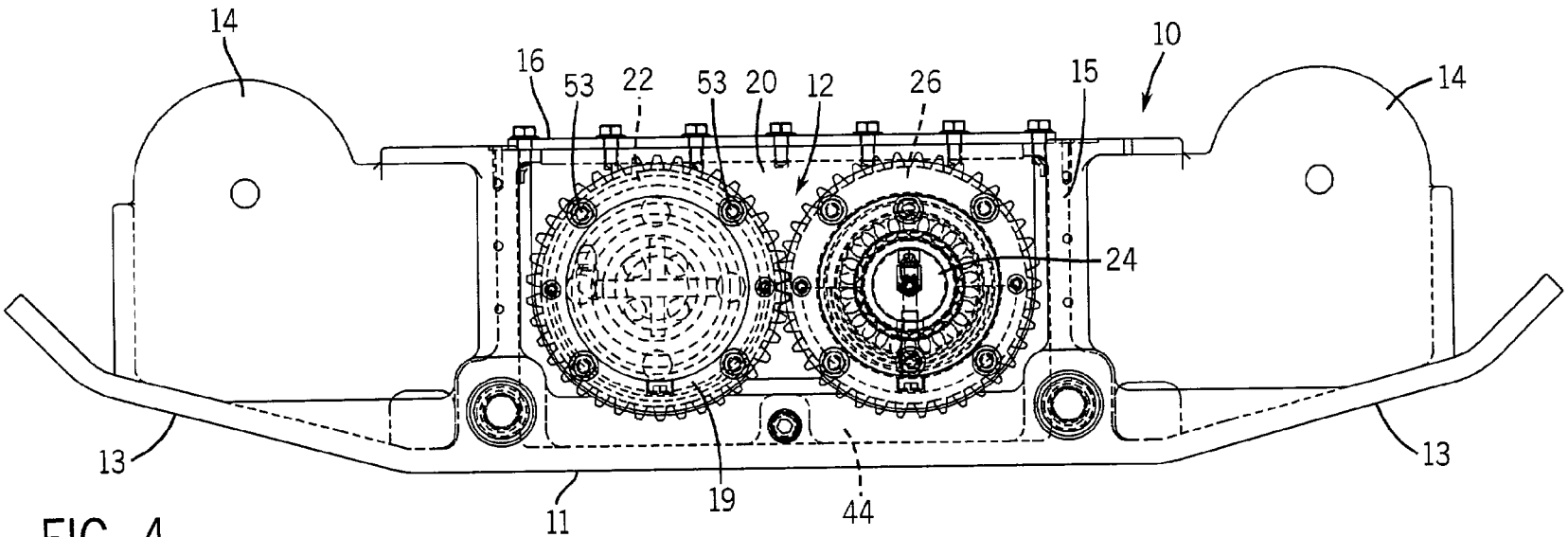
FIG. 4 is a side elevation of the apparatus shown in FIG. 2

A vibratory plate compactor 10 includes a horizontal bottom compaction plate 11 through which vertical compactive forces, generated by an attached rotary eccentric weight mechanism 12 are transmitted to the soil or other base material underlying the plate 11. The compaction plate 11, as best seen in FIG. 4, is part of a casting and includes upwardly tapered front and rear portions 13 to facilitate movement of the compactor in forward and reverse directions. The casting also includes front and rear frame members 14 that are formed integrally with the compaction plate 11 and to which are attached an operator's handle (not shown) and a drive engine with supporting brackets (also not shown). Between the front and rear frame members and also forming part of the casting is a generally rectangular main housing 15 in which the rotary eccentric weight mechanism 12 is enclosed. The housing is enclosed from above with a removable top plate 16.

The rotary eccentric weight mechanism 12 includes a main rotary input shaft 17 journaled at its opposite ends in the side walls 20 of the main housing 15 with bearings 18. A pair of main eccentric weights 21 are secured to the main input shaft 17 for rotation therewith. A drive gear 22 is also mounted on the main input shaft 17 between the eccentric weights 21 and rotates with the shaft and weights. One end of the input shaft 17 extends through the side wall 20 and has mounted thereon a drive pulley 23 for operative attachment to the drive engine with a V-belt (not shown). A driven shaft 24 is also journaled in the side walls 20 of the main housing 15 with bearings 25. The driven shaft 24 has a driven gear 26 centrally mounted thereon and in engagement with the drive gear 22 on the main input shaft 17. A pair of eccentric weights 27 are also mounted on driven shaft 24 for rotation therewith. Driving rotation of the main input shaft 17 transmits a counter-rotation to the driven shaft 24 via the gears 22 and 26.

As indicated, the eccentric weights 21 are fixed to the main input shaft 17 and the eccentric weights 27 are similarly fixed to the driven shaft 24 so that they rotate, respectively, therewith. In a manner generally known in the art, the relative rotational positions of the eccentric weights 21 and 27 on their respective shafts 17 and 24 can be varied to change the phase relationship of the forces generated during operation. The relative rotational positions of the eccentric weights are adjusted by limited rotation of the main input shaft 17 which transmits a similar but opposite limited counter-rotation to the driven shaft 24. This phase adjustment permits the compactor 10 to be driven in a forward direction at a variably adjustable speed, stopped to operate without horizontal movement, or driven at a variable adjustable speed in a reverse direction.

Figure 3:
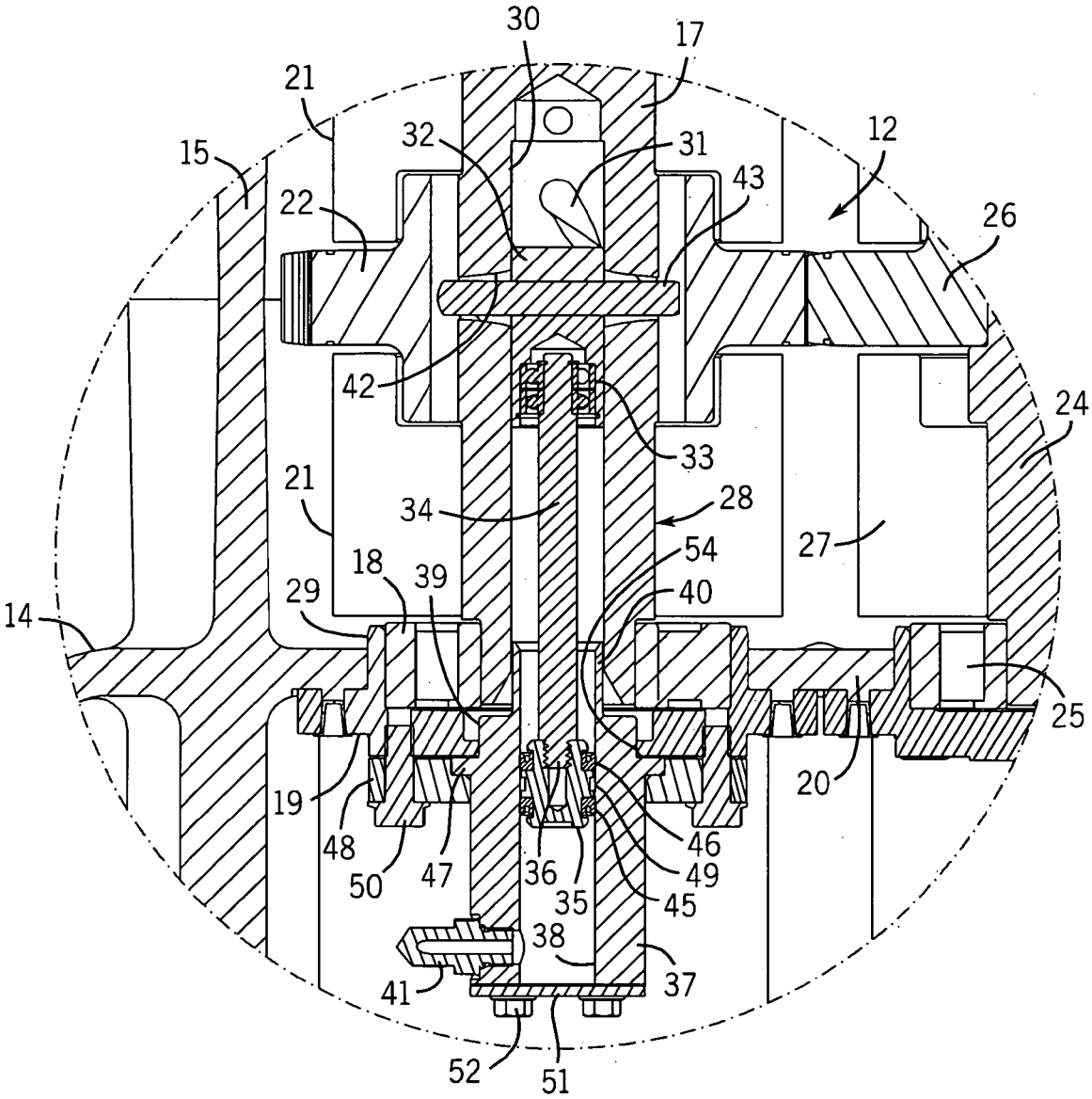
FIG. 3 is an enlarged sectional detail taken on line 3—3 of FIG. 2.

The adjustment mechanism 28 for effecting the change in eccentric weight phase is operatively connected to the main input shaft 17. This adjustment mechanism includes several features which constitute improvements over the prior art, as will be described hereinafter. The main input shaft 17 is provided with a long blind bore 30 and, near the interior end thereof, the shaft wall is provided with a pair of diametrically opposite matched helical slots 31. A cylindrical carrier 32 is slidably mounted in the bore 30 and is journaled with bearings 33 on one end of a shift rod 34 positioned axially in the bore 30. On the opposite end of the shift rod 34 is mounted a piston 35 by a threaded connection 36 comprising a threaded OD on the end of the rod 34 and a threaded ID on a counter-bore in the piston 35. The piston 35 is carried in a cylinder housing 37 which is provided with a through bore 38 within which the piston may be reciprocated axially. The cylinder housing 37 has a lead end provided with a extended sleeve 40 that extends with the clearance into the bore 30 of the input shaft 17 and provides an extended bore for the piston 35. Pressurized hydraulic fluid is supplied via a fitting 41 to the cylinder bore 38 and acts against the free face of the piston 35 to move the piston, shift rod 34 and carrier 35 in the direction away from the fitting. A cross pin 43 is mounted in a cross bore 42 in the carrier 32 as best shown in FIG. 3. The opposite ends of the cross pin 43 extend into the helical slots 31 with a small clearance so that the cross pin may slide in the helical slots. Axial movement of the adjustment mechanism 28 along the path of the helical slots causes limited rotational movement of the input shaft 17 and the drive gear 22 mounted thereon. This limited rotational movement is transferred to the driven gear 26 mounted on the driven shaft 24. The result is relative counter rotational movement of the respective eccentric weights 21 and 27, resulting in the phase adjustment described above and the resultant change in horizontal movement of the compactor 10. As indicated, the carrier 32 is journaled on the end of the shift rod 34 such that the carrier and the cross pin 43 rotate with the main input shaft 17. Thus, axial movement of the carrier under the influence of hydraulic pressure in the cylinder housing 37 may be utilized to move the cross pin in the helical slots 31 to provide on-the-fly phase adjustment while the shafts 17 and 24 are rotationally driven.

Figure 1:
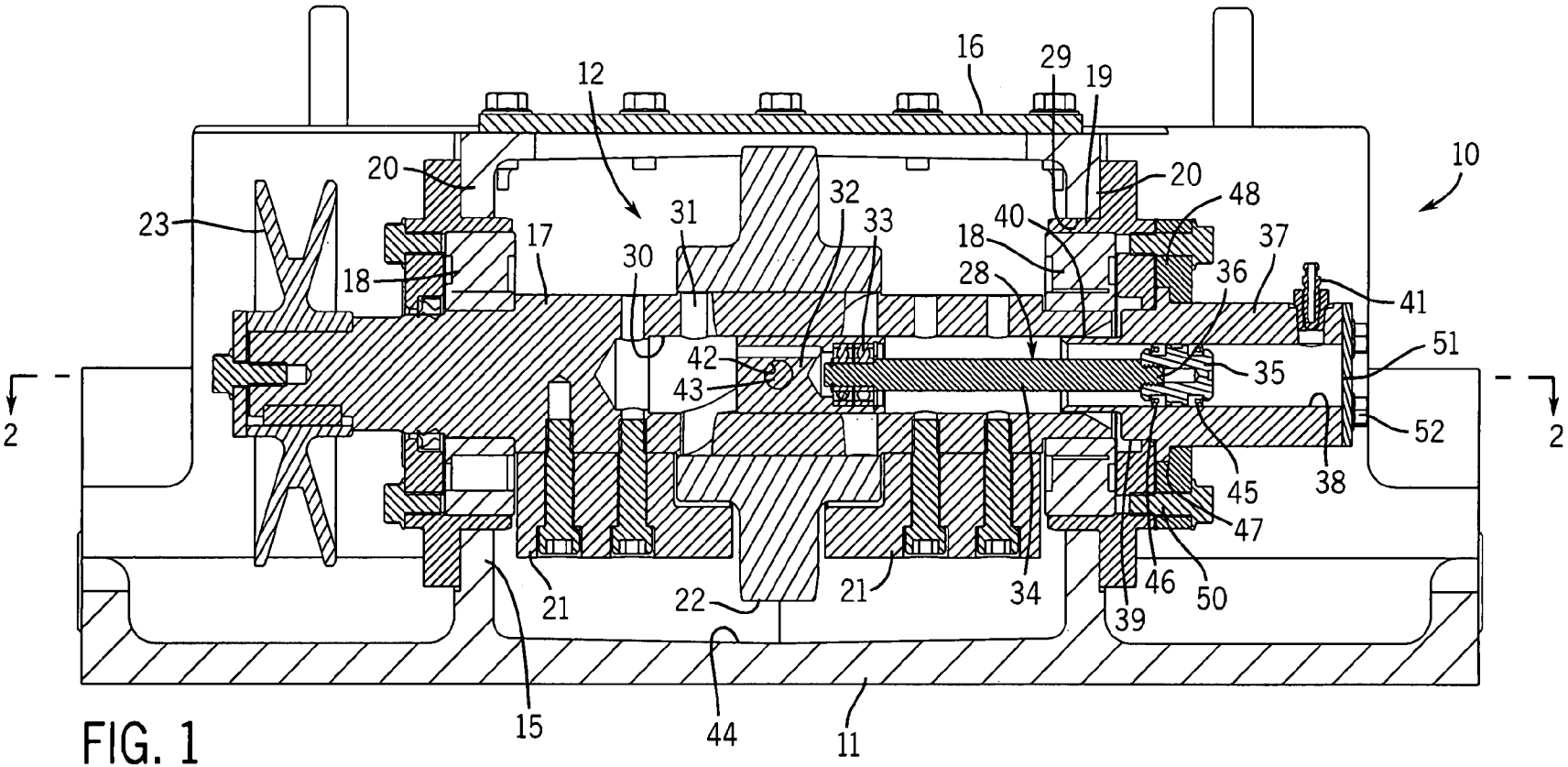
FIG. 1 is a vertical sectional view taken laterally through a vibratory plate compactor incorporating the apparatus of the subject invention.
Figure 2:
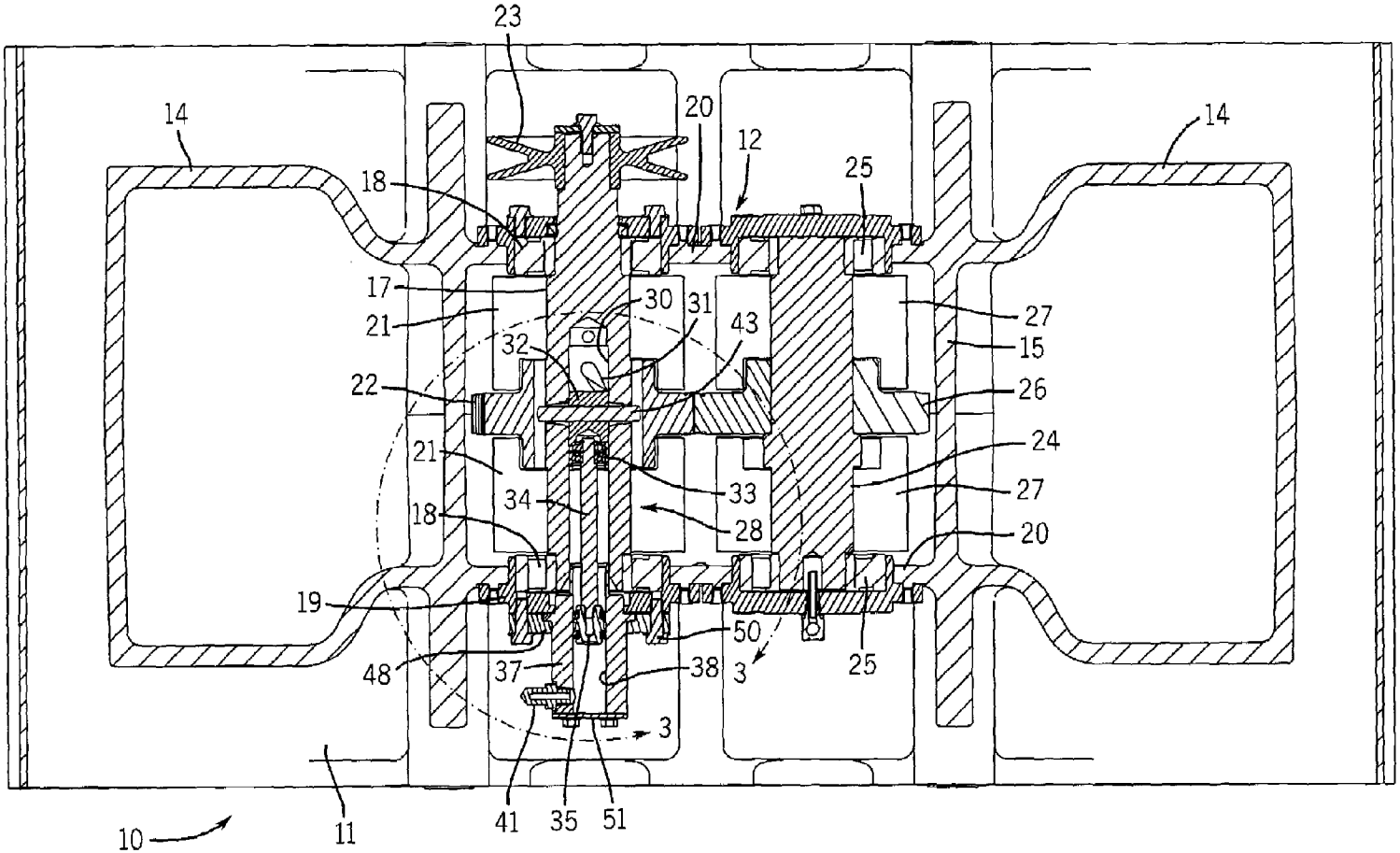
FIG. 2 is a horizontal section taken on line 2—2 of FIG. 1.

Referring again to FIG. 1 and also to FIG. 4, the bottom of the main housing 15 provides a reservoir 44 for a lubricating oil for the various bearings and gears mounted in the housing. Typically, the reservoir 44 is filled to a fairly low level sufficient to permit the teeth of the gears 22 and 26 to pick up lubricating oil during rotation and have it spread throughout the housing by the other rotating parts, such as the bearings and eccentric weights, into which it comes in contact. The rapidly rotating parts tend to break the oil into minute droplets and to even create an oil mist which penetrates and lubricates the bearings and other moving parts. The generation of high operating temperatures inside the housing 15 results in an increase in internal pressure. Although pressure relief may be provided, it has been found that, in prior art devices, a piston 35 having only a single seal, will permit the passage of lubricating oil past the piston and into the cylinder housing 37. A very small volume of leakage into the cylinder housing where it mixes with pressurized hydraulic fluid, has been found sufficient to interfere with operation of the adjustment mechanism 28. As a result, proper control of the compactor is lost. Normal wear of the single piston seal with use and seal degradation at high operating temperatures both add to worsen the leakage problem.

Referring also to FIG. 3, in addition to the single hydraulic pressure seal 45 typical of prior art constructions, the piston 35 of the present invention also includes an oppositely acting lubricant seal 46 at the opposite axial end of the piston. The piston also includes a guide ring 49 between the two seals 45 and 46, the guide ring being typical of prior art constructions. The lubricant seal 45 for the piston 35 of the improved phase adjustment mechanism is preferably a cup seal and may be of the construction and material identical to the oppositely facing hydraulic pressure seal 45. Each of the seals is, of course, oriented to enhance sealing engagement in response to increased pressure. A typical seal material for this application would be a polyether-based urethane, but other synthetic rubber materials could also be used. Instead of two separate seals 45 and 46, a single double-acting seal could be used.

Another problem with certain prior art compactor constructions was that, when seal replacement was necessary, access to the piston was difficult and time consuming, and furthermore, often required access to the interior of the main housing and removal of parts of the eccentric weight mechanism. All of this contributed to the potential for contamination. In accordance with the present invention, the cylinder housing 37 is made to be easily removable from the main housing 15, making access to the piston for repair or replacement of the seals possible without direct access to the interior of the main housing 15. The side wall 20 of the main housing 15 is provided on both sides with large circular openings 29, each of which is closed by an end cover 19 that also provides a housing for the main bearings 18. Each end cover 19 is secured to its respective side wall 20 with mounting bolts 53 (see FIG. 4). The cylinder housing 37 includes a shoulder 39 the OD of which provides a pilot surface for centering the cylinder housing in a central opening 54 in one of the end covers 19. The cylinder housing 37 also includes a peripheral flange 47 that engages the end cover 19 when the sleeve 40 is inserted into the bore 30 in the input shaft and the pilot shoulder 39 is received in the central opening 54. The housing 37 is held in place with a clamping plate 48 which, in turn, is demountably attached to the end cover 19 with four machine screws 50. When access to the piston 35 and seals 45, 46 is required, the clamping plate 48 and cylinder housing 37 are removed to expose the piston. If necessary, the piston may be pulled axially out of the housing so the seals may be removed and replaced. Preferably, however, the entire piston is removed by grasping the shift rod 34 (e.g. with a pliers) and unthreading the piston at the threaded connection 36. Then the entire piston including new seals 45 and 46 and guide ring 49 may be replaced as a unitary subassembly quickly and with a minimum of effort.

It will be noted in the drawings, such as the detail of FIG. 3, that the throughbore 38 in the cylinder housing is closed with a cover plate 51. The throughbore 38 itself is utilized simply to make machining more accurate and easy to accomplish (as compared, for example, to blind bores provided in certain prior art constructions). The cover plate 51 is attached with a number of machine screws 52, but the plate does not have to be removed for any repair or maintenance activities. With the improved construction and easy access provided by the subject invention, the piston and seal subassembly may be replaced in about 20 minutes. In the prior art construction without an easy access cylinder housing and requiring access to the piston by removal of the main top plate 16, replacement of the piston seals would take three to four hours.

We claim:

1. A quick access and easily replaceable seal arrangement for a shift rod piston in a vibratory plate compactor in which a main rotating input shaft is journaled in a main housing, the housing including a liquid lubricant reservoir, said input shaft having an axial bore in which a shift rod carrier head is journaled on the end of the shift rod opposite the piston for operative adjustable connection to the input shaft, a cylinder housing attached to the main housing and having a bore coaxial with the input shaft bore, said housing bore sized to receive the shift rod piston, and the cylinder housing having a connection to a supply of pressurized hydraulic fluid for pressurizing the cylinder housing and the head end of the piston to move the shift rod axially in the input shaft bore, the shift rod end of the piston exposed to the liquid lubricant, said arrangement comprising:

a threaded connection for demountably attaching the piston to the shift rod;

seal means providing a hydraulic fluid seal and a liquid lubricant seal between the piston and the cylinder housing bore, the hydraulic fluid seal inhibiting the passage of hydraulic fluid past the piston from the head end to the rod end, and the liquid lubricant seal inhibiting the passage of liquid lubricant past the piston from the rod end to the head end; and, a mounting device for demountably attaching the cylinder housing to the main housing.

2. The invention as set forth in claim 1 wherein said seal means comprises a pair of annular piston seals.

3. The invention as set forth in claim 2 wherein said annular piston seals comprise cup seals facing in opposite axial directions.

4. The invention as set forth in claim 1 wherein said cylinder housing includes an integral peripheral outer flange adapted to engage an outer wall end cover of the main housing, said mounting device comprises an annular clamping plate adapted to hold the cylinder housing flange in engagement with said outer wall end cover, and a plurality of threaded fasteners for attaching the clamping plate to the end cover.

5. The invention as set forth in claim 1 wherein the bore in said cylinder housing comprises a throughbore.

6. The invention as set forth in claim 5 including a cover plate enclosing an outer end of said throughbore.

7. A quick access and easily replaceable seal arrangement for a shift rod piston in a vibratory plate compactor in which a main rotating input shaft is journaled in a main housing, a large diameter end cover enclosing the housing on one axial end and providing an enclosure and mounting for an annular main bearing in which the main input shaft is journaled, the housing including a liquid lubricant reservoir, said input shaft having an axial bore in which a shift rod carrier head is journaled on the end of a shift rod opposite the piston for operative adjustable connection to the input shaft, a cylinder housing attached to the end cover and having a bore coaxial with the input shaft bore, said housing bore sized to receive the shift rod piston, and the cylinder housing having a connection to a supply of pressurized hydraulic fluid for pressurizing the cylinder housing and the head end of the piston to move the shift rod axially in the input shaft bore, the shift rod end of the piston exposed to the liquid lubricant, said arrangement comprising:

a threaded connection for demountably attaching the piston to the shift rod;

seal means providing a hydraulic fluid seal and a liquid lubricant seal between the piston and the cylinder housing bore, the hydraulic fluid seal inhibiting the passage of hydraulic fluid past the piston from the head end to the rod end, and the liquid lubricant seal inhibiting the passage of liquid lubricant past the piston from the rod end to the head end;

a circular opening in the end cover for receipt of the cylinder housing, said opening lying coaxially with the main input shaft and the main bearing and having a diameter smaller than the main bearing enclosure of the end cover; and, a mounting device for demountably attaching the cylinder housing to the end cover, whereby the cylinder housing may be removed to access the piston and shift rod to limit exposure of the main bearing to contamination.

* * * * *